US009593923B1

(12) United States Patent
Gold

(10) Patent No.: US 9,593,923 B1
(45) Date of Patent: Mar. 14, 2017

(54) SELECTABLE LETHALITY YIELD INFLATABLE GRENADE

(71) Applicant: Vladimir M. Gold, Hillside, NJ (US)

(72) Inventor: Vladimir M. Gold, Hillside, NJ (US)

(73) Assignee: The United States of the America as Represented by the Secretary of the Army, Washington, DC (US)

( * ) Notice: Subject to any disclaimer, the term of this patent is extended or adjusted under 35 U.S.C. 154(b) by 296 days.

(21) Appl. No.: 14/453,810

(22) Filed: Aug. 7, 2014

(51) Int. Cl.
*F42B 27/00* (2006.01)
*F42B 12/32* (2006.01)

(52) U.S. Cl.
CPC ..... *F42B 12/32* (2013.01); *F42B 27/00* (2013.01)

(58) Field of Classification Search
CPC ..... F42B 27/00; F42B 12/32; F42B 8/26
USPC ..... 102/482–488
See application file for complete search history.

(56) References Cited

U.S. PATENT DOCUMENTS 1,874,951 A * 8/1932 Foulon ..... F42B 30/04 102/484
1,900,790 A * 3/1933 Brandt ..... F42B 12/42 102/253
2,023,158 A * 12/1935 Williams ..... F42B 12/24 102/482
2,184,284 A * 12/1939 Coban ..... F42B 12/20 102/239
3,878,789 A * 4/1975 Hall ..... F42B 23/24 102/482
5,018,449 A * 5/1991 Eidson, II ..... F42B 12/40 102/248
5,866,841 A * 2/1999 Green ..... F42B 23/24 102/486
7,021,219 B1 * 4/2006 Dindl ..... F42B 5/045 102/447
7,784,455 B1 * 8/2010 Chong ..... F41B 11/62 102/498
2010/0199960 A1 * 8/2010 Chong ..... F41B 11/62 124/57
2010/0294157 A1 * 11/2010 Dindl ..... F42B 12/48 102/334

OTHER PUBLICATIONS

Booligan Airsoft, "http://www.booliganairsoft.com/2012/12/deep-fire-mk2-frag-grenade.html" Dec. 2012.*

* cited by examiner

*Primary Examiner* — Samir Abdosh
(74) *Attorney, Agent, or Firm* — Michael C. Sachs

(57) ABSTRACT

A selectable yield fragmentation grenade is provided with a feature for relatively easily setting the output of the grenade to a higher or to a lower yield lethality output of fragments. An operator can selectively inflate the grenade by various provisions, and such inflation lowers the grenade's lethality yield output.

2 Claims, 2 Drawing Sheets

SELECTABLE LETHALITY YIELD INFLATABLE GRENADE

U.S. GOVERNMENT INTEREST

The inventions described herein may be made, used, or licensed by or for the U.S. Government for U.S. Government purposes.

BACKGROUND OF INVENTION

There is a current unsatisfied need for a selectable yield, lethal to less-than lethal, explosive fragmentation warhead and, more particularly, for a grenade having means for selectively assigning a fragmentation lethality output ranging from full lethality level to that of less than a lethal level. For instance there is a critical need for a single device which in the field can be easily changed quickly from a higher yielding fragment size generating device which can attack vehicles, e.g., to a lesser energetic fragment generating device which can attack humans, e.g. This saves deploying in the field various different kinds of grenades for all the different targets. Of even more use still would be a grenade that can be easily set in the field on a sliding scale from full lethality all the way down to low lethality, or to a stunt level lethality and combinations inbetween.

BRIEF SUMMARY OF INVENTION

A fragmentation case is provided in this invention comprising a closed stretchable material type grenade device including therein an elastomeric material matrix band, close to the grenade outer surface skin, with a multiplicity of preformed fragments deposited therein. Within the grenade body is a main explosive charge. A selectable yield output is achieved by expanding the grenade device with gas before detonation of such main explosive charge. Gas may be added though a valve means from a compact liquid gas storage tank incorporated into the grenade. In this less lethal mode (against personnel say), gas is admitted through the valve before final detonation of the main explosive charge. Enough gas causes the fragmentation case to be rapidly expanded until the elastomeric matrix band ruptures, propelling fragments in a direction away from the main explosive charge. This mode of admitting gas causes less lethality of the fragments when the grenade finally explodes than if detonating the grenade (in the other mode) without first expanding it with gas. That is because the fragments are farther away from the main explosive charge when it explodes, so there is less propulsion of the fragments than if they were in closer proximity to the main explosive charge. Another method for supplying and dibursing gas is to employ a propellant gas generator. To be noted, where no gas or propellant is used, the grenade remains compact and is considered much more lethal and powerful in exploding its fragments. So, the lethality of the grenade may thus be selected for either high or for low lethality by the war fighter in the field, e.g., by use of gas or propellant activation. Otherwise without changing the grenade, it would be prepared to just deliver high lethality fragmentation.

OBJECTS OF THE INVENTION

Accordingly, it is an object of the present invention to provide a fragmentation grenade which can be selected by an operator to fragment with a higher, or if desired, a lower lethality yield output.

Another object of the present invention is to provide a fragmentation grenade which can be selectively inflated by an operator so that it will fragment with a higher, or if desired, a lower lethality yield output.

It is a further object of the present invention to provide a fragmentation grenade which can be selectively inflated by an operator initiating propellant within the grenade so that the grenade will fragment with a lower lethality yield output.

These and other objects, features and advantages of the invention will become more apparent in view of the within detailed descriptions of the invention, the claims, and in light of the following drawings wherein reference numerals may be reused where appropriate to indicate a correspondence between the referenced items. It should be understood that the sizes and shapes of the different components in the figures may not be in exact proportion and are shown here just for visual clarity and for purposes of explanation. It is also to be understood that the specific embodiments of the present invention that have been described herein are merely illustrative of certain applications of the principles of the present invention. It should further be understood that the geometry, compositions, values, and dimensions of the components described herein can be modified within the scope of the invention and are not generally intended to be exclusive. Numerous other modifications can be made when implementing the invention for a particular environment, without departing from the spirit and scope of the invention.

LIST OF DRAWINGS

DETAILED DESCRIPTION

Figure 1:
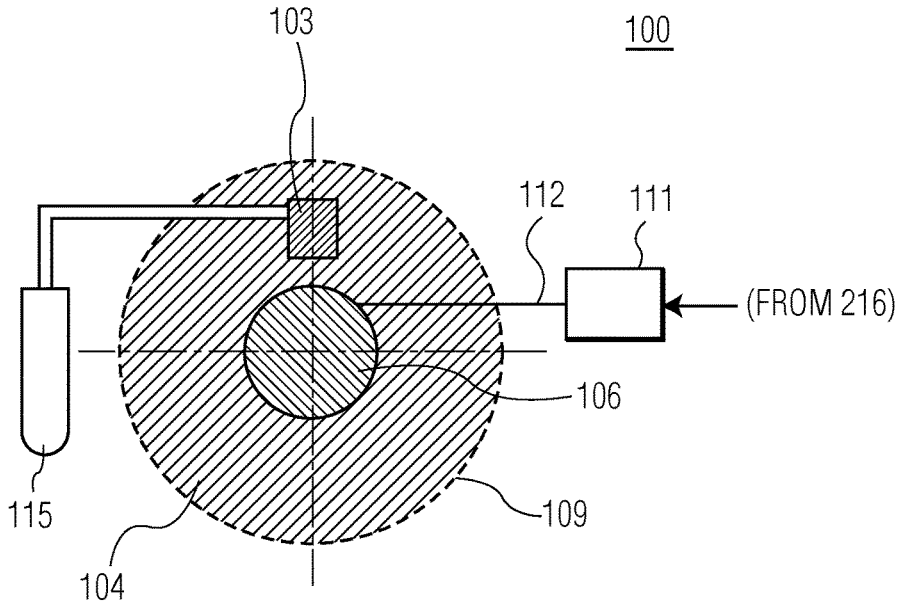
FIG. 1 shows a top cross sectional view of an inflatable grenade according to this invention.
Figure 2:
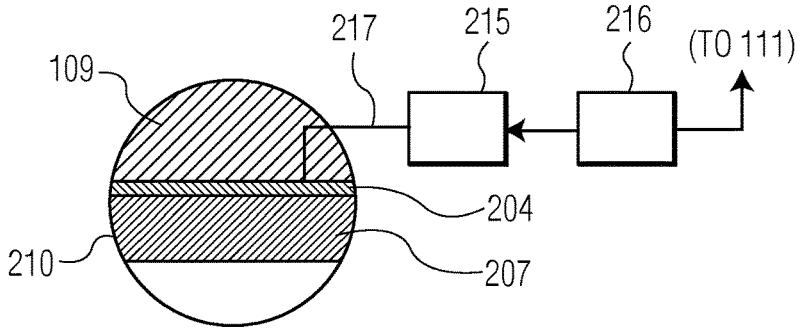
FIG. 2 shows a front view of the inflatable grenade according to this invention.
Figure 3:
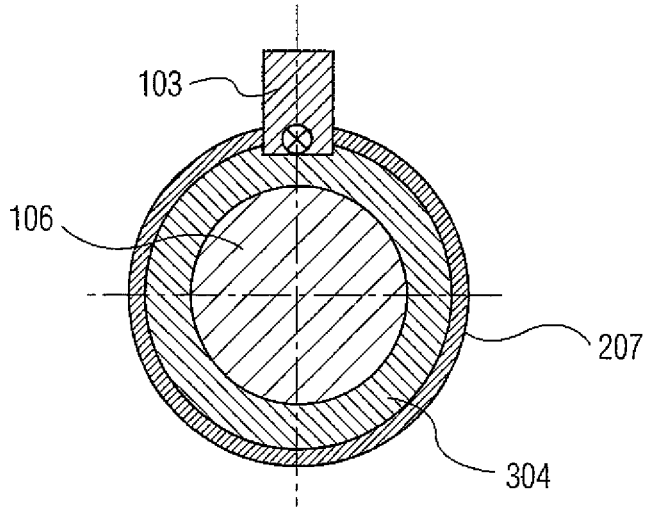
FIG. 3 shows a top cross sectional view of the inflatable grenade, in an inflated state according to this invention.
Figure 4:
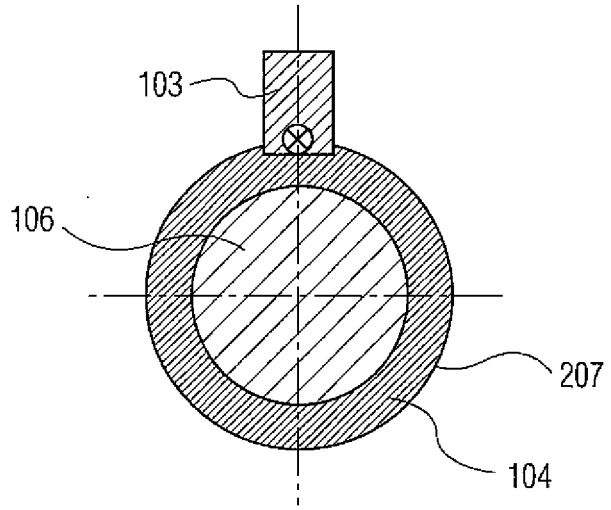
FIG. 4 shows a top cross sectional view of the inflatable grenade, in its non-inflated state according to this invention.

A fragmentation case is provided in this invention comprising a multiplicity of preformed fragments deposited into an elastomeric material matrix in a closed elastic material type grenade device. Elastometric materials might include rubber, plastic, metallic, composites or other materials. Fragments may be of tungsten alloy, steel, or any other hard high-density materials. The fragments may be molded, casted, or over molded in place in the belt and may be fixed in place in the belt by a filler material like plastic, rubber, composites, epoxies, urethanes, etc. The fragments may be a variety of shapes, sizes, materials, such as balls, cubes, or nearly any shape including star shaped, etc as dictated by the particular application, or a mixture of such shapes. A selectable yield output is achieved by expanding the grenade device. Expansion of the elastomeric fragmentation case may be accomplished by a liquid gas or by a propellant gas generator activated prior to detonating the main charge explosive which may comprise high explosives such as TNT and/or HDX/RDX or any commonly used high explosive compositions. In the less lethal mode, before detonating a main charge explosive the fragmentation case may be rapidly expanded by disbursing liquid gas (such as $CO_2$, He, $H_2$, or the like) from a relatively tiny storage cartridge included with the grenade device until the elastomeric matrix ruptures, propelling fragments away from the inner main charge explosive, and just before the final detonation of such inner explosive. Using light weight combustible gases such as H2, will increase non-lethal stunt effect by producing additional blast and light. This mode causes less lethality than if detonating the grenade without first expanding it with gas. Alternatively, detonation could be done at some longer time after adding the gas if desired. The expanded grenade device could have a diameter three times that of a non-inflated grenade device. As mentioned, a multiplicity of preformed fragments are deposited into an elastomeric material matrix. The fragmentation case has the capability of sustaining predetermined dilation to provide prescribed separation gap between the main explosive and the fragments, if desired. The shape of the warhead or grenade can be spherical, cylindrical, or complex, however, prescribing the extent of the air or gas-filled gap between the explosive and the fragmentation case will determine the amount of momentum transferred from the explosive detonation products to that of the fragments. Therefore such gap size also then dictates resulting fragment velocities, and thus grenade lethality. As was mentioned, in a full lethality mode, there is no dilation applied; the fragmentation case is in close contact with the main explosive, yielding maximum fragment velocities. In a less lethal mode, before detonating the explosive, the fragmentation case is expanded (rapidly as desired) until the elastomeric matrix raptures, propelling fragments away from the explosive. Then, approximately the entire momentum of the explosive detonation products will be deposited into the air-blast, yielding a little or no lethality in the fragments. In a partial yield mode, the grenade lethality yield may be controlled by the extent of the gap between the explosive and the (partially dilated) fragmentation case. By way of example, in FIG. 1, a grenade 100 (top cross-sectional view) has an outer elastomeric fragmentation case liner 109 which also encloses an inner main explosive charge 106. The area 104 in between 106 and 109 is normally not filled with added gas. The grenade also has means 111 to detonate said main explosive charge 106 along line 112. In a cross-sectional view normal to the surface of the fragmentation case 109, FIG. 2, fragments 210 are embedded in an elastomeric matrix 207. For a low fragment yield operation, valve 103 may be used to permit gas from connected unit gas source 115 to be added to the grenade, inside the case liner 109. A suitable gas should probably be inert for safety concerns against unwanted burning, and not of a more toxic or poisonous variety if possible. Only after inflating the grenade, the main explosive charge 106 would then be initiated. Cross-sectional view FIG. 3 illustrates an inflated grenade, including gas in inflated area 304, prior to detonation of main explosive charge 106, whereas cross-sectional view FIG. 4 illustrates a non-inflated grenade with no gas added in area 104, prior to detonation of main explosive charge 106. According to an alternative method, (see FIG. 2), dilation of the fragmentation case may be accomplished by a thin layer of propellant deposited between the explosive and the case, initiated at a predetermined time before detonating the main explosive charge. In such alternate method for inflating, an elastomeric pocket band 204 may be included to contain a small supply of propellant. And, the grenade includes means 215 to ignite said propellant along line 217 which means may include a fuze. A circuit switching means 216 (not completely detailed) may be included to control the timing of detonation of 111 and 215. Such propellant would then be activated first and cause inflating of the grenade by the releasing gas created by the propellant burn, before detonating the main explosive charge 106. In both methods of inflating the grenade prior to detonation, a selectable partial yield output may be accomplished if desired, determined by the time delay between activating the case expansion, and when detonating the main explosive charge.

While the invention may have been described with reference to certain embodiments, numerous changes, alterations and modifications to the described embodiments are possible without departing from the spirit and scope of the invention as defined in the appended claims, and equivalents thereof.

What is claimed is:

1. A selectable yield fragmentation grenade, comprising an elastomeric outer body, wherein said outer body includes fragments in a circumferential fragmentation belt, said grenade having an inside main detonation charge and means to initiate detonation of said main charge, and whereby said grenade may be exploded to lethally generate fragments by detonating said main charge, and wherein the circumferential fragmentation belt further includes propellant in a pocket band, and the grenade further includes means for selectively firing such propellant.

2. The grenade of claim 1, wherein the grenade may be selectively fully inflated by igniting said propellant before said grenade main charge is detonated, and such prior full inflation of the grenade will result in selection of a low lethal yield fragmentation pattern for the grenade upon its explosion.

* * * * *